US012735891B2

(12) United States Patent
DePaul et al.

(10) Patent No.: US 12,735,891 B2
(45) Date of Patent: Sep. 15, 2026

(54) CEILING SYSTEMS

(71) Applicant: ARMSTRONG WORLD INDUSTRIES, INC., Lancaster, PA (US)

(72) Inventors: Marie A. DePaul, Downingtown, PA (US); Corey Carvell, Lititz, PA (US); Nathan J. Baxter, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 683 days.

(21) Appl. No.: 18/079,627

(22) Filed: Dec. 12, 2022

(65) Prior Publication Data

US 2023/0183973 A1 Jun. 15, 2023

Related U.S. Application Data

(60) Provisional application No. 63/288,067, filed on Dec. 10, 2021.

(51) Int. Cl.
*E04B 9/22* (2006.01)
*E04B 9/04* (2006.01)

(52) U.S. Cl.
CPC ..... *E04B 9/225* (2013.01); *E04B 9/0428* (2013.01); *E04B 9/0464* (2013.01)

(58) Field of Classification Search
CPC ..... E04B 9/225; E04B 9/0428; E04B 9/0464; E04B 9/26
See application file for complete search history.

(56) References Cited

U.S. PATENT DOCUMENTS

| | | | | |
|---|---|---|---|---|
| 1,540,788 | A * | 6/1925 | Mcclure | E04C 2/422 52/799.12 |
| 4,221,038 | A * | 9/1980 | Singer | B23P 15/12 52/799.12 |
| 5,428,930 | A * | 7/1995 | Bagley | E04B 9/003 52/489.1 |
| 6,971,210 | B2 | 12/2005 | Kliegle | |
| 8,683,768 | B2 * | 4/2014 | Gerkes | E04B 9/0428 52/489.1 |
| 9,181,696 | B1 * | 11/2015 | Bergman | E04B 9/18 |
| 2004/0118068 | A1 * | 6/2004 | Kliegle | E04B 9/16 52/506.07 |
| 2007/0193131 | A1 | 8/2007 | Ortiz | |
| 2008/0047214 | A1 | 2/2008 | Gerkes | |
| 2011/0239566 | A1 | 10/2011 | Ciuperca | |
| 2015/0308112 | A1 * | 10/2015 | Holdridge | E04B 9/0478 52/506.08 |
| 2015/0345139 | A1 * | 12/2015 | Underkofler | E04B 9/26 52/506.08 |
| 2016/0145863 | A1 | 5/2016 | Bergman | |
| 2020/0080305 | A1 | 3/2020 | Cook | |
| 2020/0165820 | A1 | 5/2020 | Riiber | |

FOREIGN PATENT DOCUMENTS

| | | |
|---|---|---|
| JP | 2009-263939 | 11/2009 |
| JP | 2015-074874 | 4/2015 |
| JP | 2019-173418 | 10/2019 |

* cited by examiner

*Primary Examiner* — Babajide A Demuren
(74) *Attorney, Agent, or Firm* — Patrick Sheldrake

(57) ABSTRACT

Described herein are building panels, ceiling systems, and methods for using the panels and systems. Such building panels comprise a mesh member, a frame member, and a securing member.

13 Claims, 16 Drawing Sheets

CEILING SYSTEMS

CROSS-REFERENCE TO RELATED APPLICATIONS

This application claims the benefit of U.S. Provisional Patent Application No. 63/288,067 filed on Dec. 10, 2021. The disclosure of the above application is incorporated herein by reference.

FIELD OF THE DISCLOSURE

The present disclosure relates to panels for use in building materials, and more particularly to ceiling systems using such panels.

BACKGROUND

Many suspended ceiling systems have been proposed and are used extensively in building construction to improve the overall appearance of the office space, to allow access to the area above the ceiling where mechanical equipment and piping is often located, and to improve the acoustics of the space.

Suspended ceiling systems typically may use a ceiling grid as part of the suspension system with panels hanging below the ceiling grid. The problem with the prior art structures is that panels made of mesh do not hide or minimize the appearance of the ceiling grid. While lay in and tegular mesh options may exist, these are not installed below the ceiling grid and therefore, do not hide the ceiling grid.

Thus, there is a need for improved ceiling systems having mesh panels which can be installed below the ceiling grid. Embodiments of the present invention are directed to meeting these needs.

SUMMARY

This summary is intended merely to introduce a simplified summary of some aspects of one or more implementations of the present disclosure. Further areas of applicability of the present disclosure will become apparent from the detailed description provided hereinafter. This summary is not an extensive overview, nor is it intended to identify key or critical elements of the present teachings, nor to delineate the scope of the disclosure. Rather, its purpose is merely to present one or more concepts in simplified form as a prelude to the detailed description below.

Applicants have discovered mesh panels useful to display a desired aesthetic quality and capable of being taken half way down or fully uninstalled for accessibility to the plenum space.

Thus, in certain embodiments, the present invention provides a building panel comprising a mesh member comprising a first major surface opposite a second major surface, and four side surfaces extending there-between; a frame member comprising a vertical side wall having an inner surface opposite an outer surface and an upper surface opposite a lower surface; wherein the first major surface and the second major surface are defined by a perimeter, the perimeter comprising a proximal end and a distal end; wherein the perimeter of the second major surface is in contact with the lower surface of the frame member; and wherein the frame member further comprises a securing member at the upper surface at the proximal end and at the distal end. In certain embodiments, the mesh is a metal mesh. In certain embodiments, the mesh is a welded wire mesh. In certain embodiments, the mesh comprises steel. In certain embodiments, the mesh is made of wires perpendicular to each other. In certain embodiments, the building panel has a parallelogram shape having perpendicular angles, the mesh is made of a first and second set of parallel wires, wherein each set is perpendicular to the other, wherein the first set is atop and abuts the second set; wherein the perimeter further comprises side ends; wherein the proximal perimeter end and the distal perimeter end comprise a continuous wire body as the perimeter; and wherein the side ends comprises a continuous wire body and having discrete wire side end atop and abutting the continuous wire body as the perimeter. In certain embodiments, the mesh is welded to the lower or bottom surface of the frame member. In certain embodiments, the frame member comprises a wall cutout region contacting the securing member. In certain embodiments, the wall cutout region extends downward from the upper or top surface toward the lower or bottom surface. In certain embodiments, a torsion spring bracket is mounted on the cutout region. In certain embodiments, the torsion spring bracket comprises a torsion spring having a v shape. In certain embodiments, the torsion spring has a J shaped end. In certain embodiments, the torsion spring bracket comprises a saddle bracket comprising a first wall plate, a second wall plate, and a bight portion connecting the first and second wall plates. In certain embodiments, the bight portion of the saddle bracket is located above the upper or top surface of the frame member; and wherein the first wall plate is located adjacent to the inner surface of the frame member; and wherein the second wall plate is located adjacent to the outer surface of the frame member. In certain embodiments, the frame comprises two apertures from the inner surface to the outer surface, wherein each aperture flanks the cutout region and abuts the torsion spring bracket. In certain embodiments, each aperture comprises a rivet connecting the frame to the torsion spring bracket.

In other embodiments, the invention is a building panel comprising a frame member; a mesh member comprising a first major surface opposite a second major surface, the second major surface comprising a central region circumscribed by a perimeter region; a securing member; and wherein the perimeter region of the second major surface of the mesh member is coupled to the frame member; and wherein the securing member is coupled to the frame member. In certain embodiments, the frame member comprises a vertical side wall having an inner surface opposite an outer surface; and an upper surface edge opposite a lower surface edge. In certain embodiments, the perimeter region of the second major surface of the mesh member is coupled to the lower surface of the frame member. In certain embodiments, the securing member contacts the inner surface of the vertical side wall of the frame member. In certain embodiments, the vertical side wall of the frame member comprises a wall cutout region that at least partially overlaps with the securing member. In certain embodiments, the securing member comprises a hook member. In certain embodiments, the wall cutout region extends downward from the top edge toward the bottom edge. In certain embodiments, the hook member of the securing member at least partially overlaps with the wall cutout region of the vertical side wall of the frame member. In certain embodiments, the securing member is a saddle bracket comprising a first wall plate, a second wall plate, and a bight portion connecting the first and second wall plates. In certain embodiments, the bight portion of the securing member is located above the top edge of the vertical side wall of the frame member; and wherein the first wall plate is located adjacent to the inner surface of the vertical side wall of the frame member; and wherein the second wall plate is located adjacent to the outer surface of the vertical side wall of the frame member. In certain embodiments, the securing member further comprises saddle bracket cutout region that at least partially overlaps with the wall cutout region of the frame member. In certain embodiments, the hook member overlaps with the saddle bracket cutout region.

In other embodiments, the invention is a saddle bracket for a ceiling system, the saddle bracket comprising a saddle member comprising; a bight portion, a first wall plate, and a second wall plate collectively defining a frame receiving cavity that extends along a central vertical plane; a cutout out region extending downward from the bight portion into the first wall plate and the second wall plate; and a hook member extending from the first wall plate; wherein hook member at least partially overlaps with the cutout region along a vertical direction. In certain embodiments, the cutout region extends from the bight portion to a cutout region floor. In certain embodiments, the hook member comprises a first portion extending from the first wall plate; a second portion extending from the first portion; and a third portion extending from the second portion; wherein the first portion extends upward from the cutout region floor, the second portion extends outward from the first portion; and the third portion extends downward from the second portion. In certain embodiments, the second portion is located vertically between the cutout region floor and the bight portion.

In other embodiments, the invention is a ceiling system comprising a ceiling suspension grid and a building panel comprising a mesh member comprising a first major surface opposite a second major surface, and four side surfaces extending there-between; a frame member comprising a vertical side wall having an inner surface opposite an outer surface and an upper surface opposite a lower surface; wherein the first major surface and the second major surface are defined by a perimeter, the perimeter comprising a proximal end and a distal end; wherein the perimeter of the second major surface is in contact with the lower surface of the frame member; and wherein the frame member further comprises a securing member at the upper surface at the proximal end and at the distal end. In certain embodiments, the mesh is a metal mesh. In certain embodiments, the mesh is a welded wire mesh. In certain embodiments, the mesh comprises steel. In certain embodiments, the mesh is made of wires perpendicular to each other. In certain embodiments, the building panel has a parallelogram shape having perpendicular angles, the mesh is made of a first and second set of parallel wires, wherein each set is perpendicular to the other, wherein the first set is atop and abuts the second set; wherein the perimeter further comprises side ends; wherein the proximal perimeter end and the distal perimeter end comprise a continuous wire body as the perimeter; and wherein the side ends comprises a continuous wire body and having discrete wire side end atop and abutting the continuous wire body as the perimeter. In certain embodiments, the mesh is welded to the lower or bottom surface of the frame member. In certain embodiments, the frame member comprises a wall cutout region contacting the securing member. In certain embodiments, the wall cutout region extends downward from the upper or top surface toward the lower or bottom surface. In certain embodiments, a torsion spring bracket is mounted on the cutout region. In certain embodiments, the torsion spring bracket comprises a torsion spring having a v shape. In certain embodiments, the torsion spring has a J shaped end. In certain embodiments, the torsion spring bracket comprises a saddle bracket comprising a first wall plate, a second wall plate, and a bight portion connecting the first and second wall plates. In certain embodiments, the bight portion of the saddle bracket is located above the upper or top surface of the frame member; and wherein the first wall plate is located adjacent to the inner surface of the frame member; and wherein the second wall plate is located adjacent to the outer surface of the frame member. In certain embodiments, the frame comprises two apertures from the inner surface to the outer surface, wherein each aperture flanks the cutout region and abuts the torsion spring bracket. In certain embodiments, each aperture comprises a rivet connecting the frame to the torsion spring bracket.

In other embodiments, the invention is directed towards a method for installing a ceiling system having a building panel as described in any embodiment described herein, comprising connecting the building panel to a ceiling system.

In other embodiments, the invention is directed towards a method for using a ceiling system having a building panel as described in any embodiment described herein, comprising installing the building panel to a ceiling system.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

DESCRIPTION OF THE DRAWINGS

The detailed description of the invention will be better understood when read in conjunction with the appended drawings. It should be understood, however, that the invention is not limited to the precise arrangements and instrumentalities of the embodiments shown in the drawings.

FIG. 7*a* shows the view for the upper right corner of FIG. 6. FIG. 7*b* shows the view for the lower left corner of FIG. 6;

FIGS. 8*a* and 8*b* show top view perspectives of mesh wiring arrangements, according to certain embodiments of the invention.

FIGS. 8*c* to 8*f* show top perspective and angular top perspective views of further embodiments of mesh member arrangements;

FIG. 9*a* shows a top perspective view. FIG. 9*b* shows a side view;

FIG. 10*a* shows a top perspective view. FIG. 10*b* shows a side view;

FIG. 11*a* shows an angular frontal and top perspective view. FIG. 11*b* shows a side perspective view;

DETAILED DESCRIPTION

Figure 1:
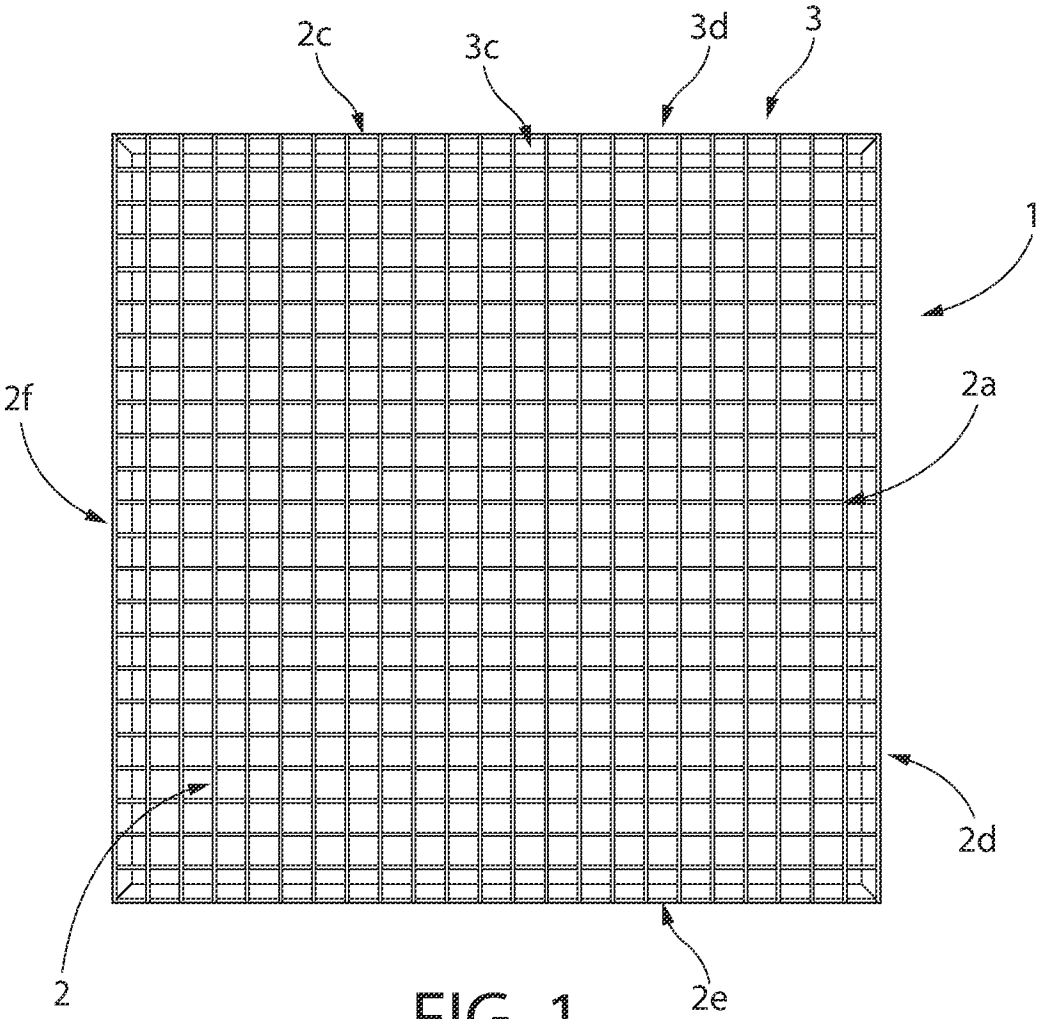
FIG. 1 is a bottom perspective view of a building panel according to one embodiment of the invention.

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other applications and methods. It is to be understood that the invention is not limited in its application to the details of any particular embodiment shown. The terminology used herein is for the purpose of description and not to limit the invention, its application, or uses.

As used herein and in the appended claims, the singular forms "a", "an", and "the" include plural references unless the context dictates otherwise. The singular form of any class of the ingredients refers not only to one chemical species within that class, but also to a mixture of those chemical species. The terms "a" (or "an"), "one or more" and "at least one" may be used interchangeably herein. The terms "comprising", "including", "containing", and "having" may be used interchangeably. The term "include" should be interpreted as "include, but are not limited to". The term "including" should be interpreted as "including, but are not limited to".

As used throughout, ranges are used as shorthand for describing each and every value that is within the range. Any value within the range can be selected as the terminus of the range.

Unless otherwise specified, all percentages and amounts expressed herein and elsewhere in the specification should be understood to refer to percentages by weight of the total composition. Unless otherwise specified, reference to a molecule, or to molecules, being present at a "wt. %" refers to the amount of that molecule, or molecules, present in the composition based on the total weight of the composition.

According to the present application, use of the term "about" in conjunction with a numeral value refers to a value that may be +/−5% of that numeral. As used herein, the term "substantially free" is intended to mean an amount less than about 5.0 wt. %, less than 3.0 wt. %, 1.0 wt. %; preferably less than about 0.5 wt. %, and more preferably less than about 0.25 wt. % of the composition.

Unless defined otherwise, all technical and scientific terms used herein have the same meanings as commonly understood by one of ordinary skill in the art to which this invention belongs. All patents, patent applications, publications, and other references cited or referred to herein are incorporated by reference in their entireties for all purposes. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing (if applicable) under discussion. These relative terms are for convenience of description only and, unless specified otherwise, do not require that the apparatus be constructed or operated in a particular orientation.

As used herein, terms such as "attached," "affixed," "connected," "coupled," "interconnected," and the like refer to a relationship wherein structures are secured or attached to one another either directly or indirectly through intervening structures, as well as both movable or rigid attachments or relationships, unless expressly described otherwise. Accordingly, the disclosure is not limited to such exemplary embodiments illustrating certain combinations of features that may exist alone or in combination with other features.

The present disclosure is directed towards building panels and ceiling systems useful to display a desired aesthetic quality, provide for beneficial sound acoustics, and to introduce convenient panel removing solutions. In certain embodiments, the ceiling system is a suspended ceiling system.

In certain embodiments, the present invention is a building panel comprising a mesh member comprising a first major surface opposite a second major surface, and four side surfaces extending there-between; a frame member comprising a vertical side wall having an inner surface opposite an outer surface and an upper surface opposite a lower surface; wherein the first major surface and the second major surface are defined by a perimeter, the perimeter comprising a proximal end and a distal end; wherein the perimeter of the second major surface is in contact with the lower surface of the frame member; and wherein the frame member further comprises a securing member at the upper surface at the proximal end and at the distal end. In certain embodiments, the securing member further comprises a torsion spring.

The building panel may be utilized in various aspects. In certain embodiments, the building panel is a ceiling panel. In certain embodiments, the building panel is a wall panel. In certain embodiments, the building panel is used as both a ceiling panel and a wall panel.

Figure 2A:
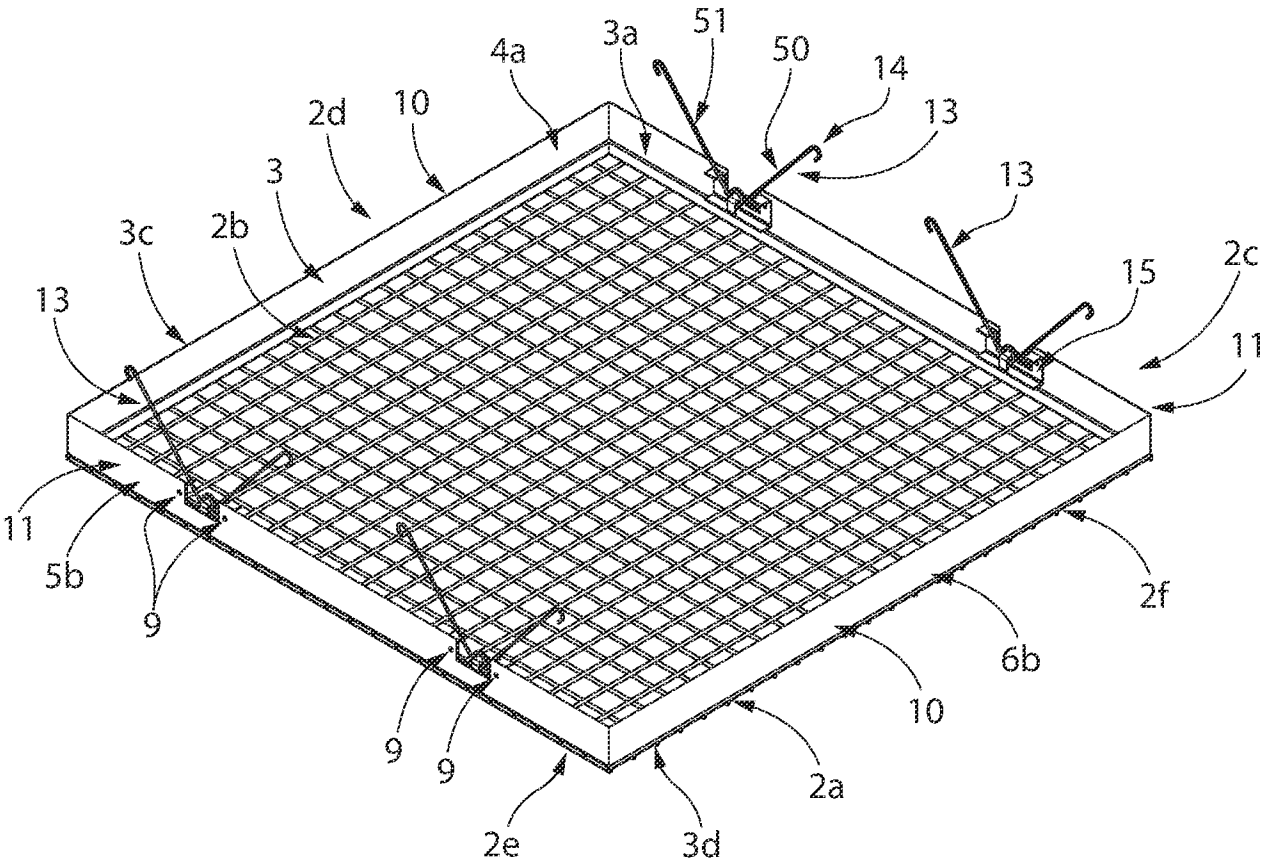
FIGS. 2*a*-2*b* show angular top perspective views of building panel embodiments according to the present invention.
Figure 2B:
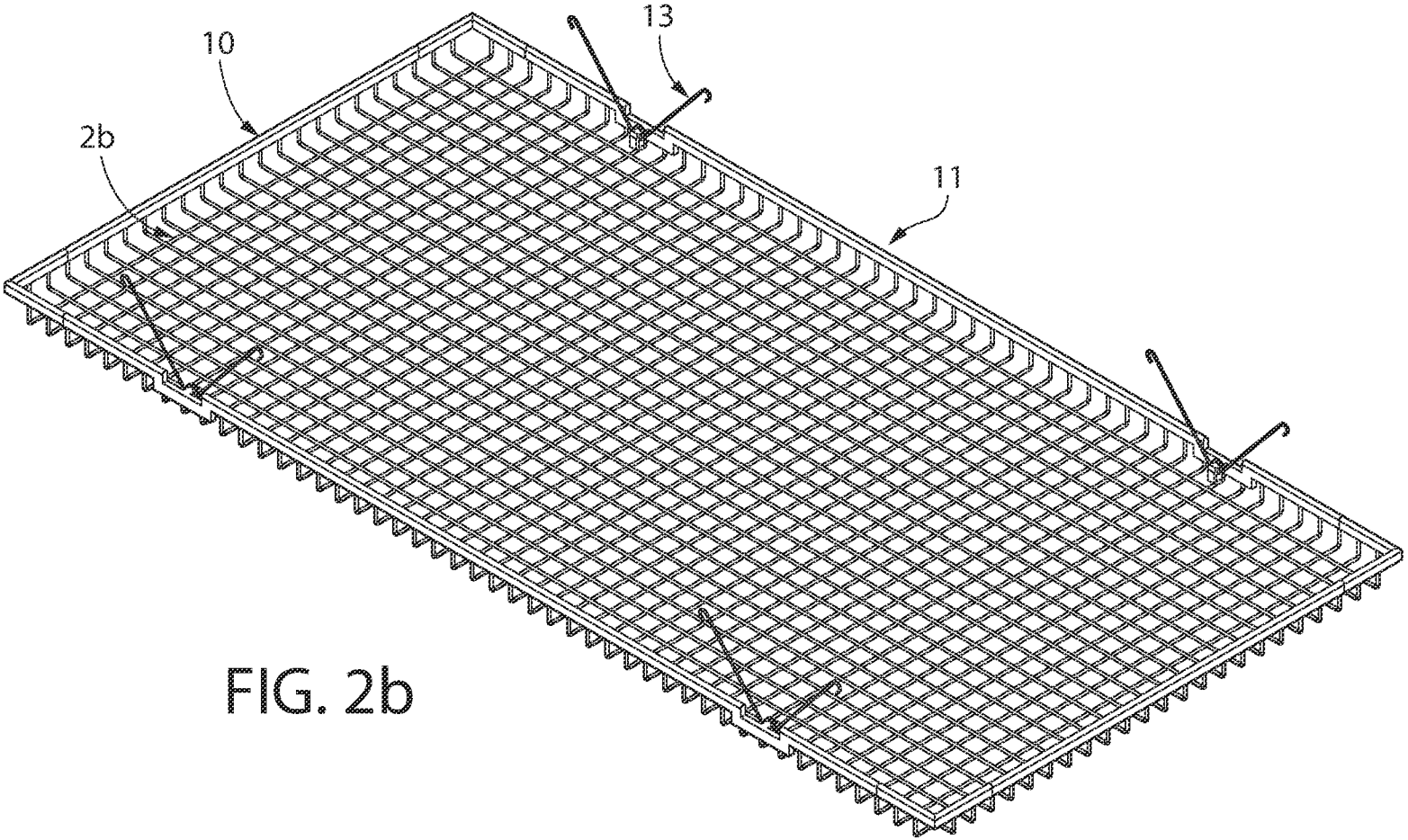
Figure 3:
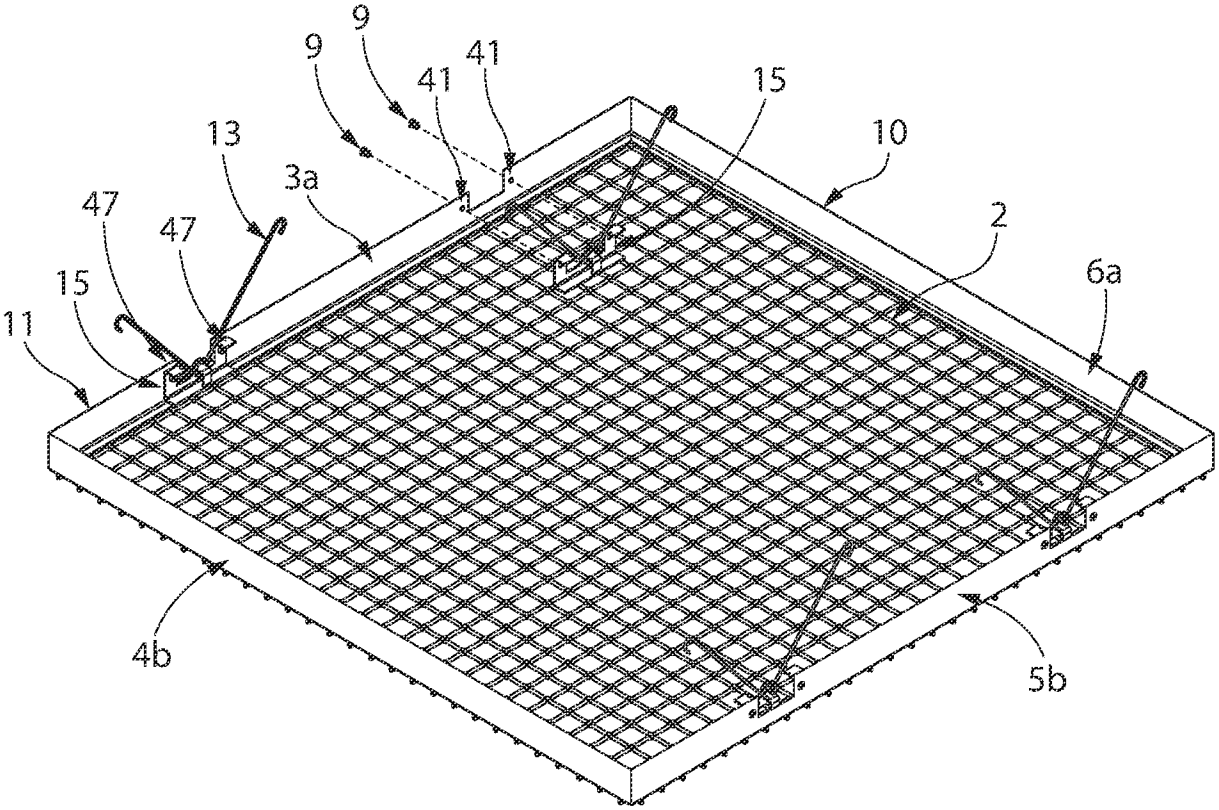
FIG. 3 is an angular top perspective view of a building panel according to an embodiment of the present invention showing the structural insertion arrangement of a torsion spring bracket to the aperture of a back angle having bracket cutouts and associated rivet placement.
Figure 4A:
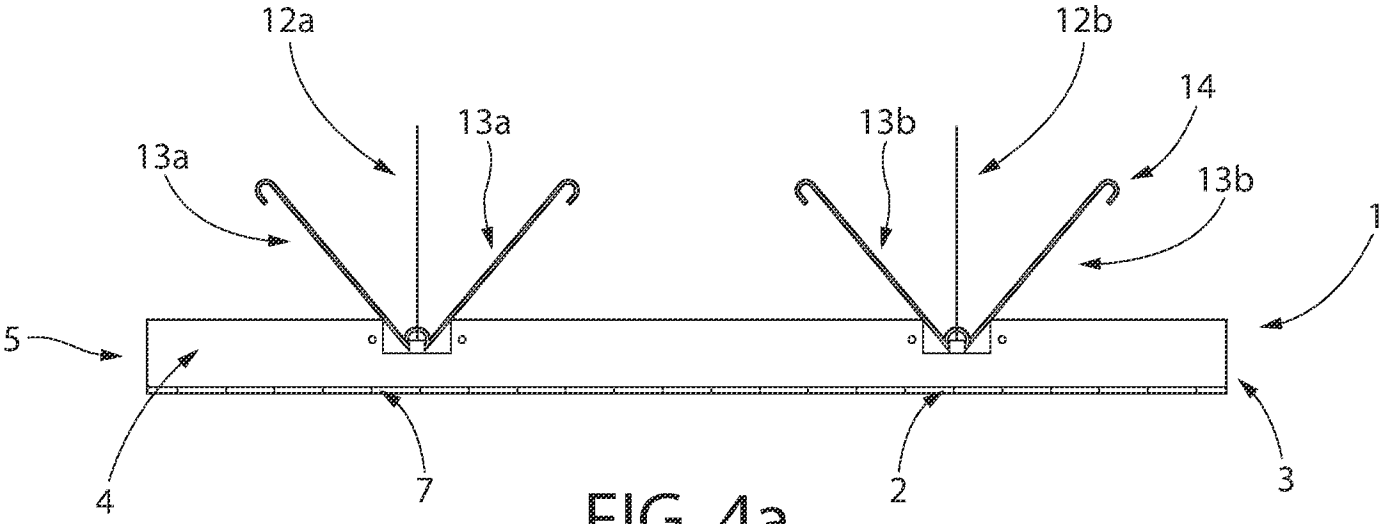
FIGS. 4*a* and 4*b* show side perspective views of a building panel according to one embodiment of the invention.
Figure 4B:
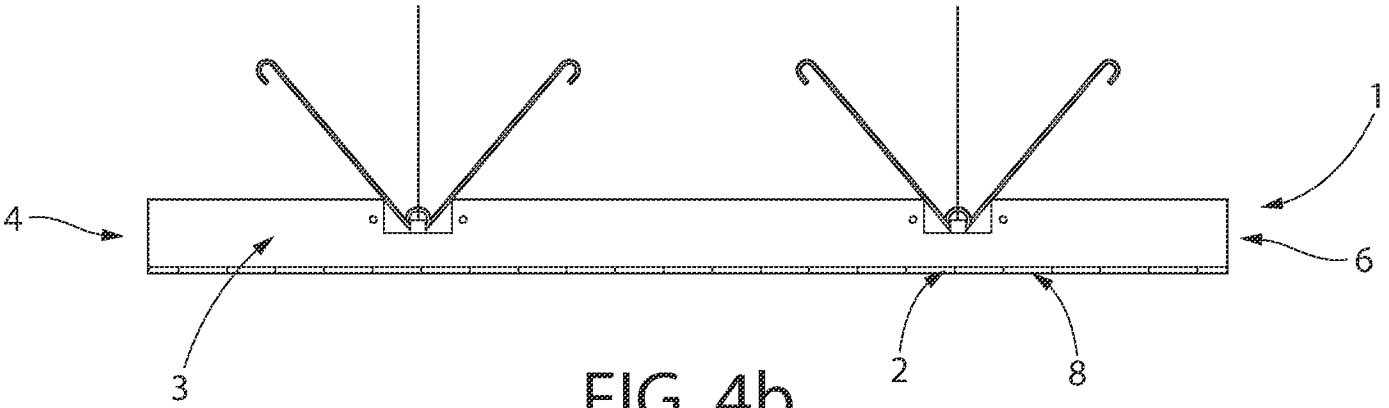

Referring to FIGS. 1 and 2*a*-*b*, according to one embodiment, the building panel 1 comprises a mesh member 2 (which may also be referred to as a welded wire mesh, expanded mesh, or woven mesh) and a frame member 3. The building panel 1 may further comprise a securing member 15.

The building panel 1 may have various shapes and sizes. In certain embodiments, the building panel 1 has a parallelogram shape. In certain embodiments, the building panel has perpendicular angles. In certain embodiments, the building panel 1 is shaped as a square or rectangle. The building panel 1 has a proximal end and a distal end.

Figure 9B:
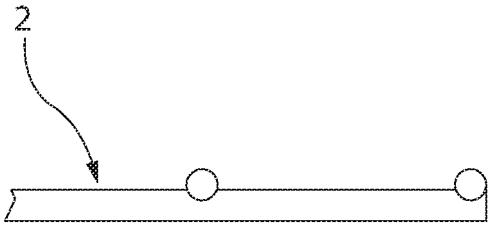
FIGS. 9*a* and 9*b* show mesh wiring arrangements, according to certain embodiments of the invention.
Figure 9A:
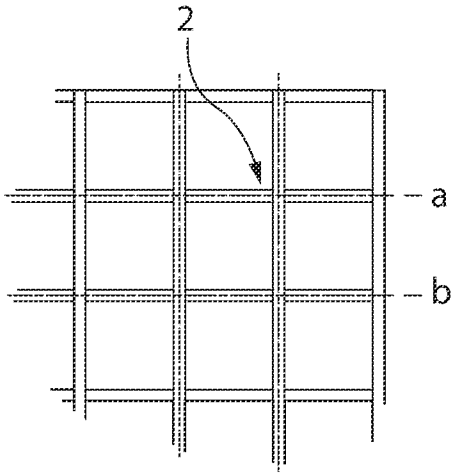
Figure 10B:
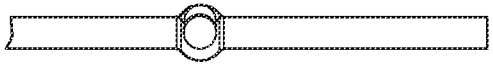
FIGS. 10*a* and 10*b* show a mesh wiring arrangement, according to certain embodiments of the invention.
Figure 10A:
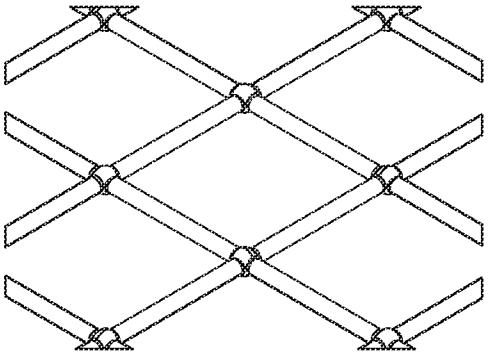

The mesh member 2 has a first major surface 2*a* opposite a second major surface 2*b*, and four side surfaces extending there-between 2*c*, 2*d*, 2*e*, and 2*f*. The first major surface 2*a* and the second major surface 2*b* are defined by a central region circumscribed by a perimeter region, the perimeter comprising a proximal end and a distal end. In preferred embodiments, the proximal end of the mesh member 2 is also the proximal end of the building panel 1 and the distal end of the mesh member 2 is also the distal end of the building panel 1. As shown in FIGS. 1 and 2*a*, the third side surface 2*e* is at a proximal end and the first side surface 2*c* is at a distal end. In certain embodiments, the perimeter region of the second major surface 2*b* may be coupled to the frame member 3, as shown in FIG. 2*a*. In other embodiments, the perimeter region of the second major surface 2*b* is angled upwards and may be coupled to the frame member 3, as shown in FIG. 2*b*. The securing member 15 may be coupled to the frame member 3. The mesh member 2 extends from the lower frame surface at the proximal end to the lower frame surface at the distal end and from the adjacent side to the opposite frame side. In this non-limiting depiction, the adjacent sides are perpendicular to each other. In some embodiments, the mesh member 2 is made of a first and second set of parallel wires, wherein each set is perpendicular to the other, wherein the first set is atop and abuts the second set. In some embodiments, the proximal perimeter end and the distal perimeter end of the mesh member 2 comprise a continuous wire body as the perimeter (as is shown in FIG. 10*b*). In some embodiments, the mesh member 2 comprises a side end in between the proximal end and distal end. In some embodiments, the side end comprises a continuous wire body and has a discrete wire side end atop and abutting the continuous wire body as the perimeter (as is shown in FIG. 9*b*).

The mesh member 2 may be made of various materials and shapes. In certain embodiments, the mesh is a metal mesh. In certain embodiments, the mesh comprises steel. In certain embodiments, the mesh is a welded wire mesh.

Figure 8B:
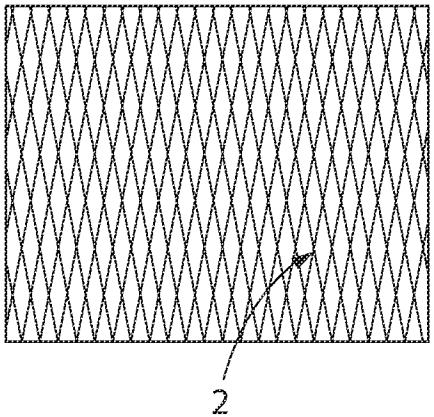
FIGS. 8*a* to 8*f* show various mesh member embodiments.
Figure 8A:
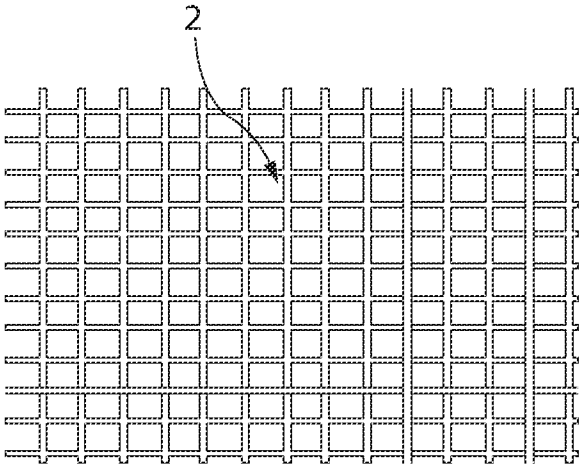
Figure 8D:
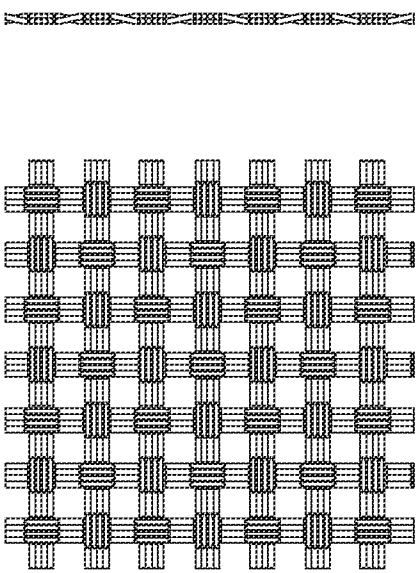
Figure 8C:
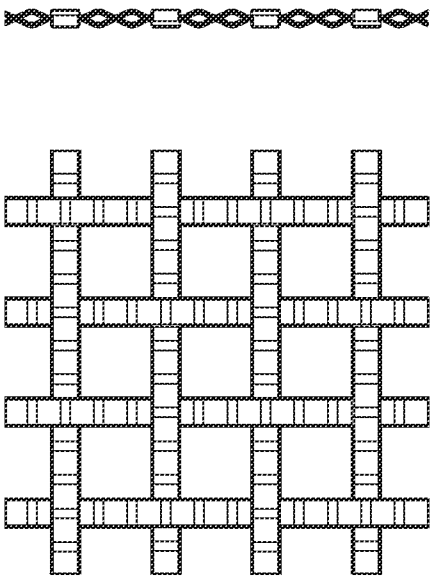
Figure 8F:
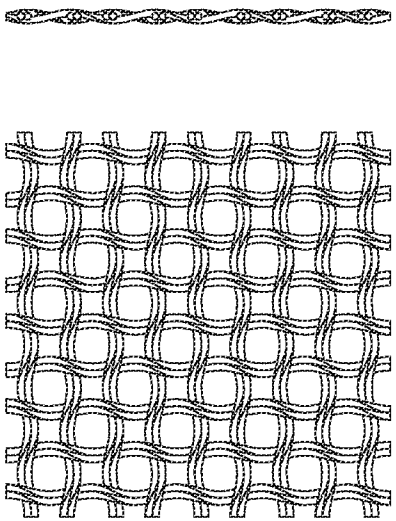
Figure 8E:
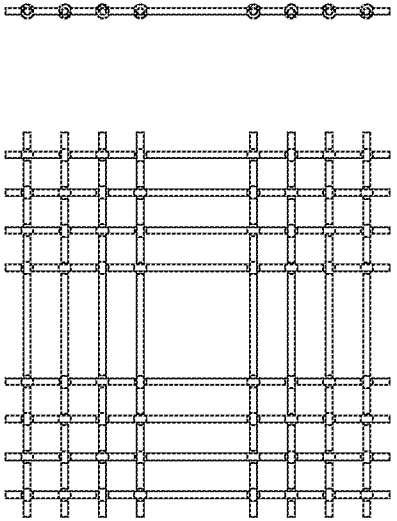

The pattern of the wires of the mesh member 2 may vary. In certain embodiments, the mesh member 2 is made of wires perpendicular to each other (see, for example, FIGS. 8*a* and 8*d*). The perpendicular pattern may include single wires strung in each direction (such as shown in FIG. 8*a*), or alternatively, the perpendicular pattern may include sets of 3 to 5 wires strung in each direction (FIG. 8*d* shows a set or four wires in each direction). In other embodiments, the mesh member 2 is made of wires crossed to formed diamond shaped meshing (see, for example, FIG. 8*b*). In certain embodiments, the wire has a flattened shape and may be crimped together prior to forming a mesh member 2, as shown in FIG. 8*c*. In certain embodiments, set of wires, such as about 2 to 5 wires, or a pair of two wires, may be spun into a helical shape and woven together to form the mesh member 2. FIG. 8*f* shows such a pattern using a pair of two wires. The spacing of the wires may vary. In some embodiments, the individual wires may be spaced apart from each other or from each set to form various patterns, such as shown in FIGS. 8*d* and 8*e*. In certain embodiments, the distance between first wire mesh and a second wire mesh may be from about 0.75 in to about 2.5 in—including all values therebetween. In certain embodiments, the mesh member 2 is made of wires perpendicular to each other, each parallel wire having a spacing from about 0.9 in to about 1.3 in. In certain embodiments, the mesh member 2 is made from sets of wires (for example, each set having from about 2 to about 8 parallel wires), wherein each set is perpendicular to the other, and each set may have a spacing from about 0.9 in to about 1.3 in. The thickness, or diameter, of the mesh wires may vary. In certain embodiments, the wire diameter is from about 0.08 in to about 0.2 in—including all values therebetween.

The peripheral edges of the mesh member 2 may have various orientations. In certain embodiments, the peripheral edges of the mesh member 2 may lie in a plane parallel to the first major surface 2*a* opposite a second major surface 2*b*. In other words, the mesh member may have a flat shape. In other embodiments, the peripheral edges of the mesh member 2 may bend at an upward angle with respect to the second major surface 2*b*, as shown in FIG. 2*b*. The bend may be at up to a 90° with respect to the second major surface 2*b*. In certain embodiments, the peripheral edges of the mesh member 2 are bent upwards to be perpendicular to the second major surface 2*b*.

The frame member 3 comprises a vertical side wall having an inner surface opposite an outer surface; and an upper surface opposite a lower surface. In certain embodiments, the frame member 3 comprises four vertical side walls comprising an inner surface (3*a*, 4*a*, 5*a*, and 6*a*) opposite an outer surface (3*b*, 4*b*, 5*b*, and 6*b*; respectively) and an upper surface 3*c* opposite a lower surface 3*d*. In certain embodiments and as shown, the perimeter of the second major surface 2*b* is in contact with the lower surface 3*d* of the frame member 3. In certain embodiments, the building panel 1 further comprises a securing member 15 which contacts the inner surface of a vertical side wall of the frame member (as shown, for example, in FIGS. 2 to 4*b* and 12). In other embodiments, the building panel 1 comprises a securing member 15 which contacts the upper surface, inner surface, and outer surface of the frame member 3 (as shown, for example, in FIGS. 6 and 11*a-b*). In certain embodiments, the securing member 15 may be located at the proximal end and at the distal end of the building panel 1. In certain embodiments, the securing member 15 comprises a torsion spring bracket. In certain embodiments, the frame member 3 comprises a pair of uncut back angles 10 and a pair of cut back, or cutout region, back angles 11. The back angles may vary in size. In certain embodiments, the back angles have a height of from about 1 in to about 2.5 in—including all values therebetween. In certain embodiments, the back angles have a length of from about 18 in to about 96 in, from about 20 in to about 40 in, or from about 20 in to about 25 in—including all values therebetween.

Figure 13:
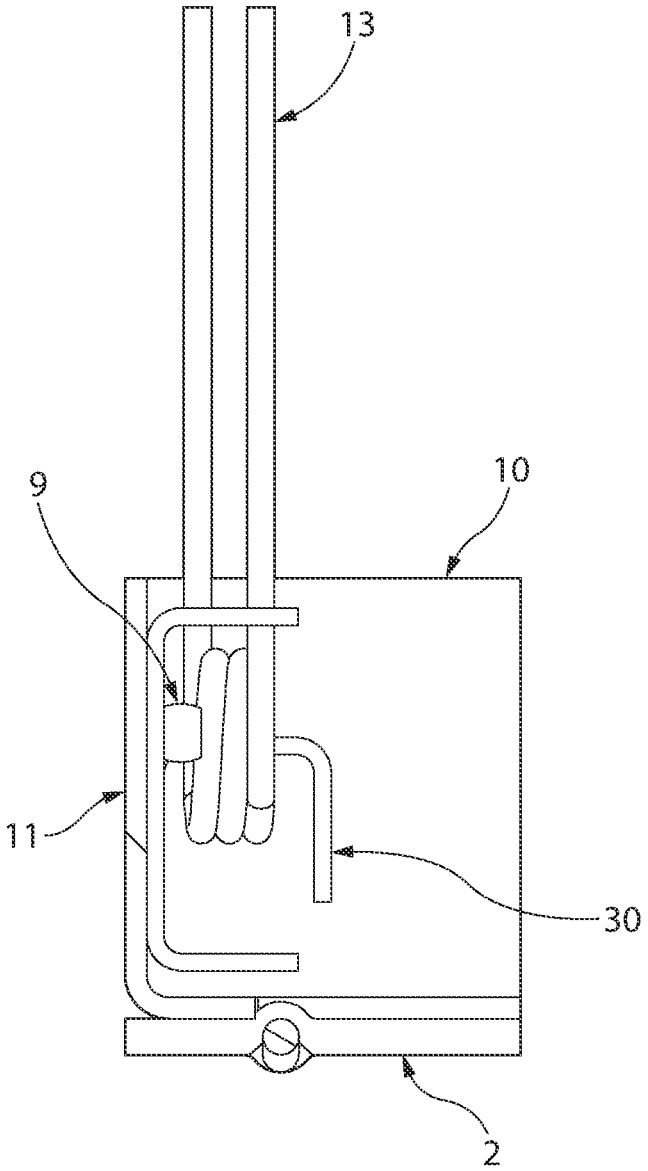
FIG. 13 is a side view of the torsion spring bracket embodiment as shown in FIG. 12.

The cutout back angle 11 comprises a cutout region at the upper or top surface at a proximal end and at a distal end. In certain embodiments, the cutout region extends downward from the upper or top surface of the cutout back angle 11 toward the lower or bottom surface of the cutout back angle 11, but does not meet the lower or bottom surface. The cutout region may have a length of from about 1 in to about 2.5 in, from about 1 in to about 2 in, or from about 1 in to about 1.75 in—including all values therebetween. The cutout region may have a height of from about 0.4 in to about 1.5 in, from about 0.5 in to about 1.25 in, or from about 0.5 in to about 1 in—including all values therebetween. In certain embodiments, the cutout region is flanked by apertures, useful in mounting the securing member 15 to the frame 3 (see, for example, FIG. 13). In certain embodiments, the cutout region contacts the securing member. In certain embodiments, the securing member is mounted onto the cutout region. In certain embodiments, the mesh member 2 is welded to the lower surface 3*d* of the frame member 3.

The frame member 3 of the building panel may be made of varying components. In certain embodiments, the frame member 3 comprises a nonwoven material. In certain embodiments, the frame member 3 comprises excelsior material, which also refers to softwood shavings used for stuffing. In certain embodiments, the frame member 3 comprises plastic, wood, or excelsior, or a combination thereof. In certain embodiments, the frame member 3 is made from excelsior.

Referring to FIGS. 2*a-b*, 3, 4*a-b*, 12 and 13, in certain embodiments, the torsion spring bracket 15 is an integrally formed singular component comprising a wall plate 44 with an upper plate 47 extending from one end and a base plate 43 extending from an opposite end. In some embodiments, both upper late 47 and base plate 43 extend in the same direction. The upper plate 47 is substantially parallel to the base plate 43. The upper plate 47 is substantially perpendicular to the wall plate 44. In certain embodiments, the wall plate 44 comprises at least two apertures 42. The apertures 42 are useful for support of a fastening means, such as, but not limited to a rivet 9, to attach the torsion spring bracket 15 to the frame member 3. In certain embodiments, the upper plate 47 comprises a first upper surface portion 45 and a second upper surface portion 46. In some embodiments the first upper surface portion 45 is coplanar with the second upper surface portion 46. The first upper surface portion 45 extends from one end of the wall plate 44 and the second upper surface portion 46 extends from an opposite lateral end of the wall plate 44. The first upper surface portion 45 extends a length that is measured along a direction parallel to a base plate 43. The second upper surface portion 46 extends a length that is measured along a direction that is parallel to the base plate 43. In certain embodiments, the torsion spring bracket 15 may comprise a torsion spring 13 having a v shape. In certain embodiments, the torsion spring end 14 is J shaped.

In certain embodiments, the torsion spring bracket 15 comprises a hook member 48. The hook member 48 is coupled to the wall plate 44. The hook member 48 may comprise a first portion that extends upward from the wall plate 44. The hook member 48 also comprises a second portion that extends either from the first portion or from the wall plate 44, and is parallel to the base plate 43. The hook member 48 further comprises a third portion extending downward from the second portion toward the base plate 43 and terminates in a free end. The first portion, if present, and the second portion are substantially perpendicular to each other. The second portion and third portion are substantially perpendicular to each other. The first and the third portion may be substantially parallel to each other. In some embodiments, at least a portion of the hook member 48 is co-planar with the wall plate 44. In some embodiments, the length of the wall plate 44 is greater than the length of the first portion of the hook member 48.

The torsion spring 13 comprises a ring portion 38, a first spring leg 50 and a second spring leg 51. The ring portion 38 may be a coiled spring that has a central opening 52. The ring portion 38 has a height of between about 10 mm to about 300 mm. The ring portion 38 has a wall thickness of between about 10 mm to about 300 mm.

Figure 5:
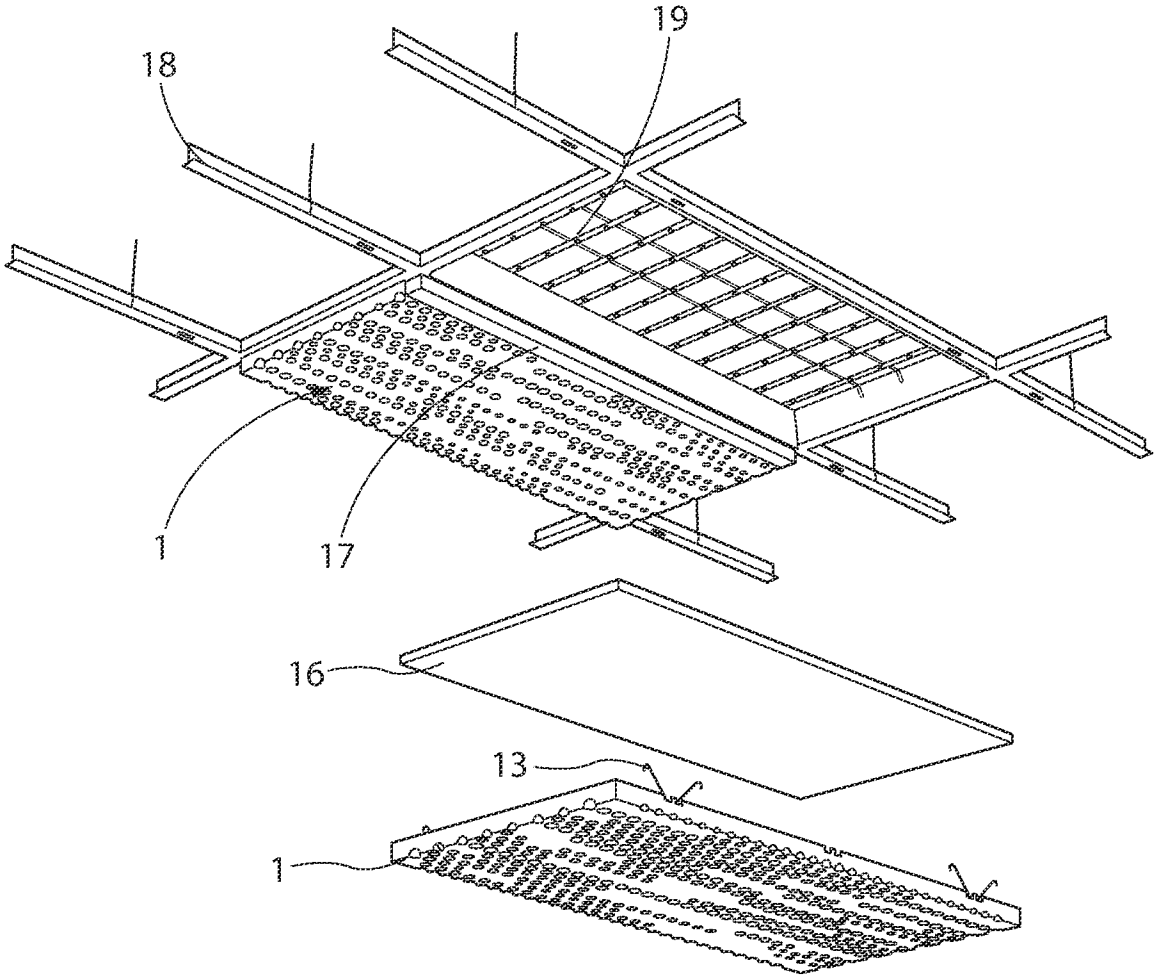
FIG. 5 is a schematic view of a ceiling system according to one embodiment of the invention. The figure includes a building panel, a torsion grid, a panel backer, and light elements.

The building panel 1 may be a component of a ceiling system, for example, as shown in FIG. 5. The ceiling system may comprise a building panel 1, optionally having a back panel 16 applied above the second major surface 2*b*. In certain embodiments, the back panel 16 may be made of a frosted material. In certain embodiments, the back panel 16 may comprise an acoustic material. The ceiling system may further comprise a suspension system. The suspension system may comprise a grid, such as, but limited to, a torsion grid 18. The ceiling system may further comprise light elements. In certain embodiments, the light elements may be LED lights. In certain embodiments, the light elements may be placed in between the building panels 1 of the ceiling system to yield inline light elements 17. In certain embodiments, the light elements may be placed above the building panels 1 (or farther from the room floor) of the ceiling system to yield a light element panel backlight 19.

Figure 6:
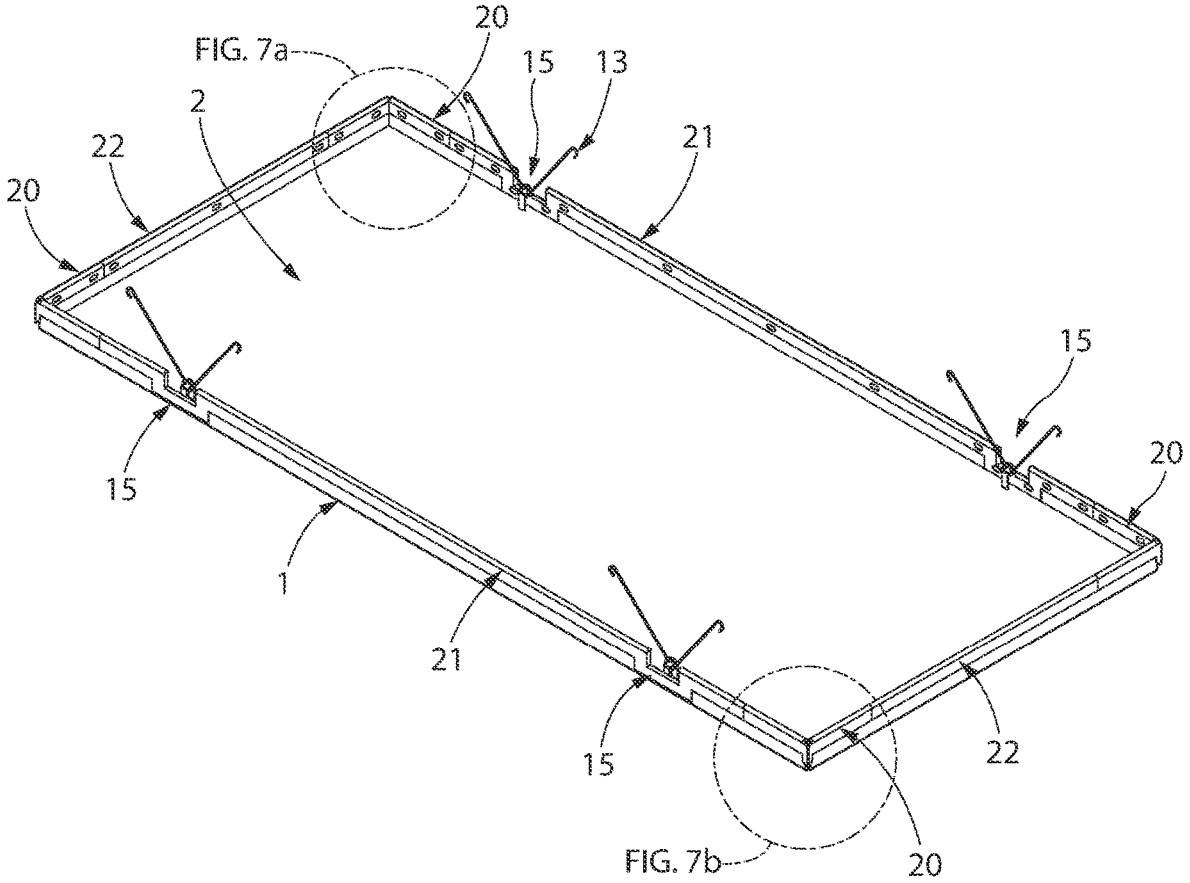
FIG. 6 is an angular top perspective view of a building panel according to one embodiment of the invention.
Figure 7B:
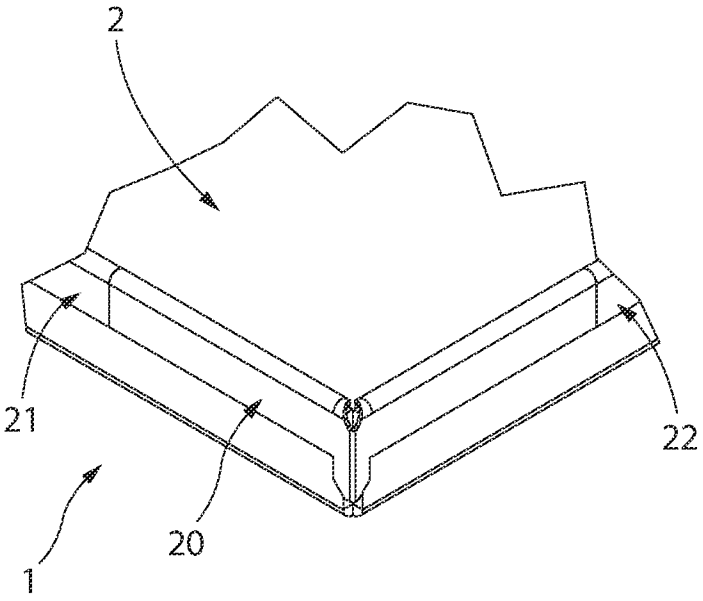
FIGS. 7*a* and 7*b* show a zoomed in and expanded angular top perspective view of the corner bracket of the embodiment shown in FIG. 6.
Figure 7A:
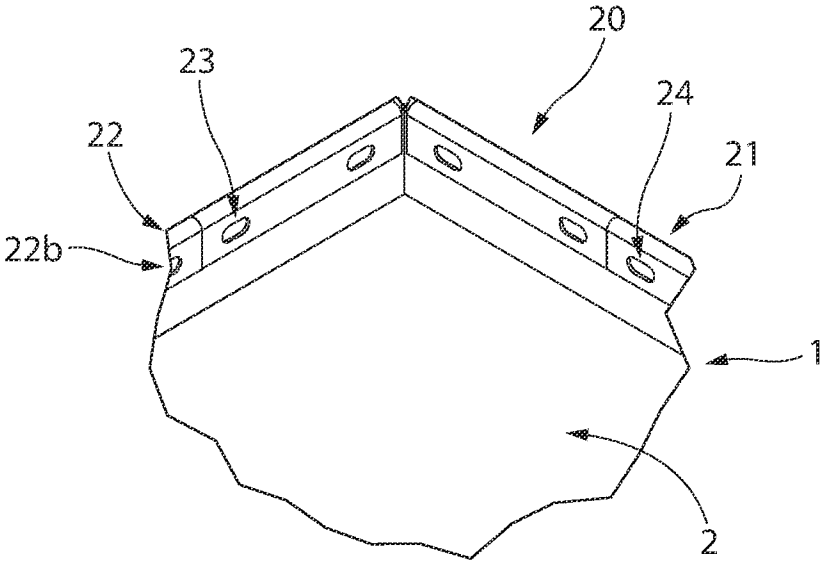

Referring to FIGS. 6 and 7*a-b*, in certain embodiments, the building panel 1 further comprises a corner bracket 20 at each corner of the frame 3, end side U edging 22 at the proximal and distal ends of the building panel 1, and cutout containing U edging 21 on the sides of the building panel 1. In other embodiments, edges of the mesh 2 are bent upwards to about a 90-degree angle relative to the second major surface 2*b* along all 4 sides. In this embodiment, the u-edging 21, end side U edging 22, and corner brackets 20 are directly coupled to the upward bent edges of the mesh 2. FIG. 6 shows the securing member 15 located within and contacting the cut back angle regions 11 of the cutout containing U edging 21. FIG. 7 shows a zoomed in view of the circled top right and bottom left regions of FIG. 6, respectively. The corner bracket 20 may comprise at least one aperture 23 to assist in securing the corner bracket 20 to the upper surface of the frame member 3, or mesh 2, depending on the embodiment. The cutout containing U edging 21 may also comprise at least one aperture 24 to help secure the cutout containing U edging 21 to the upper surface of the frame member 3, or mesh 2, depending on the embodiment. The end side U edging 22 may also comprise at least one aperture 22*b* to help secure the end side U edging 22 to the upper surface of the frame member 3, or mesh 2, depending on the embodiment.

Figure 11B:
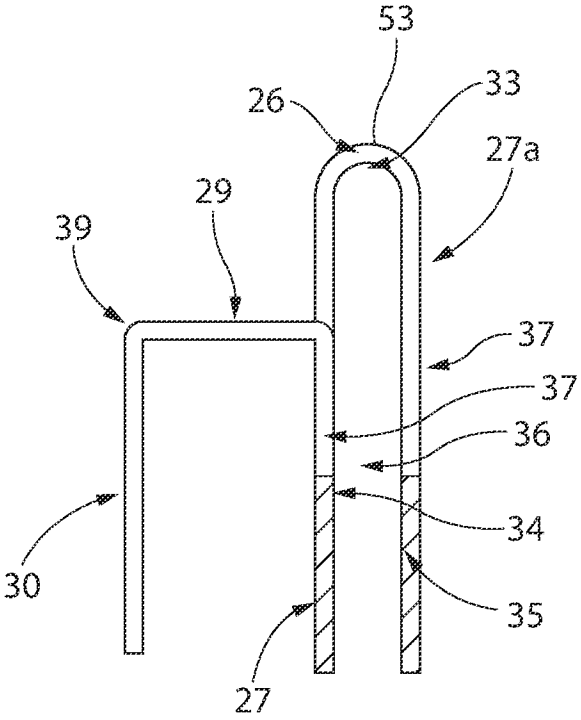
FIGS. 11*a* and 11*b* show views of a torsion spring bracket according to certain embodiments of the invention.
Figure 11A:
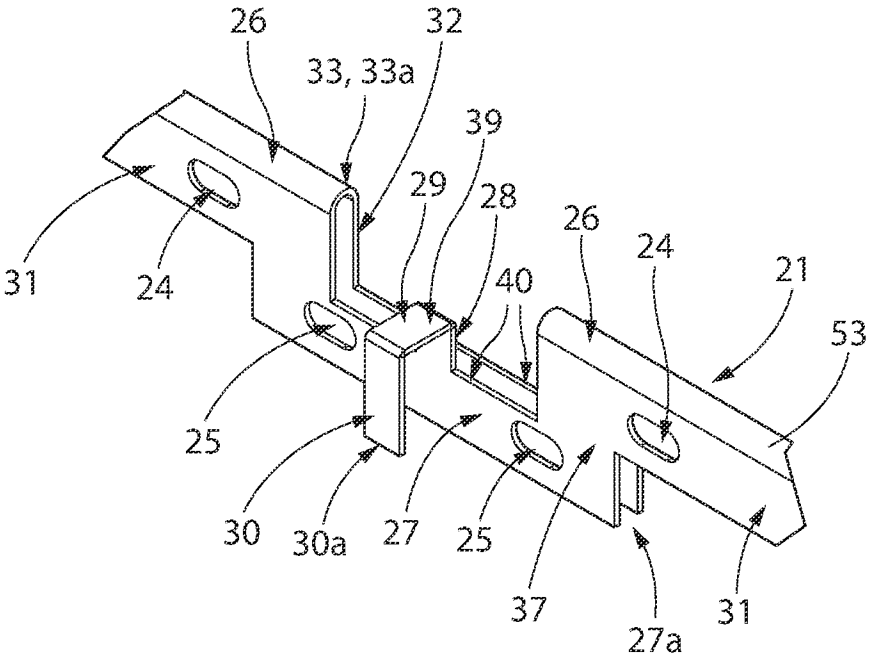
Figure 12:
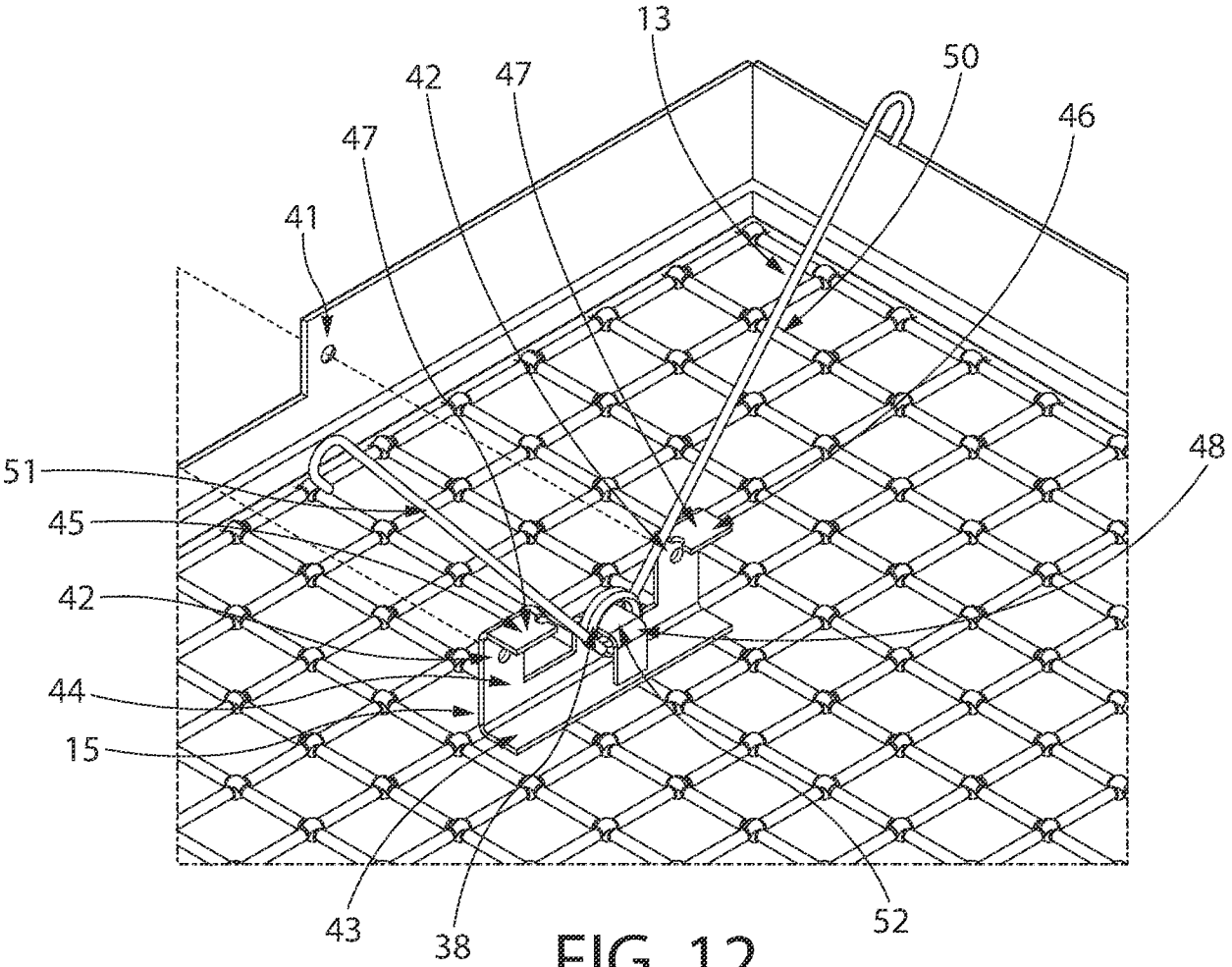
FIG. 12 is an angular top perspective view of an embodiment of a torsion spring bracket according to the invention.

Referring to FIG. 11*a-b*, in alternate embodiments, the torsion spring bracket 15 is an integrally formed singular component having a body configured for mounting over the upper surface of the frame member 3. Within this embodiment, the torsion spring bracket 15 may comprise a saddle bracket 53, which is used as mounting portion 37, and a hook member 39. In certain embodiments, the saddle bracket 53 comprises an inverted U-shaped central mounting portion 26 (may also referred to as a bight portion) configured to engage the upper or top surface of the frame. Central mounting portion 26 may be comprised of a horizontal top cervical wall 33 and a pair of opposing and laterally spaced apart vertical sidewalls 34 and 35 forming a downwardly open receptacle 36 for receiving the upper frame surface and portions of inner surface and outer surface of the frame. The saddle bracket 53 has a front plate 27 (or first wall plate) and a back plate 27*a* (or second wall plate) extending therefrom. The front plate 27 and back plate 27*a* comprise a bracket cutout on the upper portion of the plates which forms an upper surface of the central mounting portion 21, an upper surface or a cutout region floor 40 of the front and back plate (which is below the central mounting portion 26), a side surface 32 of cutout, and a side wall 33*a* on the central mounting portion 26. The front plate 27 further comprises a hook member 39. In certain embodiments, the front plate 27 and back plate 27*a* further comprise a pair of lower coupling apertures 25 useful for coupling the torsion spring bracket 15 to the frame 3. The torsion spring bracket 15 further comprises an upper wing portion 31 at both lateral ends of the bracket, the bottom of the upper wing portion being at about a level orientation with the upper surface 40 from the cutout. In certain embodiments, the upper wing portion 31 comprises upper wing coupling apertures 24. In certain embodiments, the bight portion 26 of the securing member 15 is located above the top edge of the vertical side wall of the frame member, the first wall plate 27 is located adjacent to the inner surface of the vertical side wall of the frame member; and wherein the second wall plate 27*a* is located adjacent to the outer surface of the vertical side wall of the frame member.

The torsion spring bracket 15 comprises a hook member 39 coupled to the torsion spring bracket front plate portion 27. The hook member 39 comprises a first plate portion 28 that extends upward from the front plate upper surface or the cutout region floor 40 of the torsion spring bracket front plate portion 27. The hook member 39 also comprises a second plate portion 29 that extends from the first plate portion 28 and above the upper surface or the cutout region floor 40. The hook member 39 further comprises a third plate portion 30 extending downward from the second plate portion 29 and terminates in a free end 30*a*. The first portion 28 and the second portion 29 are substantially perpendicular to each other. The second 29 and third portion 30 are substantially perpendicular to each other. The first portion 28 and the third portion 30 are substantially parallel to each other.

An important characteristic for building panel materials is the ability to reduce the amount of reflected sound in a room. One measurement of this ability is the Noise Reduction Coefficient (NRC) rating as described in ASTM test method C423. This rating is the average of sound absorption coefficients at various octave bands (e.g., 100, 250, 500, 1000, and 2000 Hz), where, for example, a system having an NRC of 0.90 has about 90% of the absorbing ability of an ideal absorber. A higher NRC value indicates that the material provides better sound absorption and reduced sound reflection. However, the sound absorption of a material that covers a flat surface depends not only on the physical properties of the material but also on the way in which the material is mounted over the surface. ASTM test method E75 provides test specimen mounting types (e.g., D-20, E-400) to be used during sound absorption tests. In certain embodiments, the acoustic building panel has a noise reduction coefficient (NRC) of about 0.65 to about 0.90 as determined in an E-400 mount. In certain embodiments, the acoustic building panel has a noise reduction coefficient (NRC) of about 0.90 as determined in an E-400 mount. In certain embodiments, the acoustic building panel has a noise reduction coefficient (NRC) of about 0.55 to about 0.60 as determined in a D-20 mount.

Another important characteristic for building panel materials is the burning performance. ASTM E84-20 provides methods to determine the relative burning behavior of the material. In particular, ASTM E84-20 provides methods for determining the Flame Spread Index (FSI) which characterizes how far flames generated on the test material spread. The FSI is measured from 0 (indicating no flames) to 200 (which indicates spreading flames). ASTM E84-20 also provides methods for determining the Smoke Developed Index (SDI) which states how much smoke is generated. SDI is measured on a scale of 0 to 450, which correlates to no smoke generated (value of 0) to thick, heavy smoke (value of 450). Obtained FSI and SDI values are then compiled and applied to a three-tiered class system: Class A, Class B, and Class C, with Class A rated materials producing minimal to no flames or smoke, while Class C materials producing the most flames or smoke. In order to qualify as an E84 Class A fire rating, a flame spread index (FSI) of 25 or less and smoke developed index at 450 or less must be exhibited. In certain embodiments, the acoustic building panel has a flame spread index (FSI) of about 0 to about 10, as determined by ASTM E84-20. In certain embodiments, the acoustic building panel has a flame spread index (FSI) of about 10 as determined by ASTM E84-20. In certain embodiments, the acoustic building panel has a flame spread index (FSI) of about 0 as determined by ASTM E84-20. In certain embodiments, the acoustic building panel has a smoke developed index (SDI) of about 5 or less as determined by ASTM E84-20.

In certain embodiments, the acoustic building panel has a noise reduction coefficient (NRC) of about 0.80, as determined in an A mount. In certain embodiments, the acoustic building panel has a noise reduction coefficient (NRC) of about 0.80, as determined in a D-20 mount. In certain embodiments, the acoustic building panel has a flame spread index (FSI) of about 25, as determined by ASTM E84-20. In certain embodiments, the acoustic building panel has a smoke developed index (SDI) of about 15, as determined by ASTM E84-20.

In certain embodiments, the building panel is a component of a ceiling system. In certain embodiments, the ceiling system is a suspended ceiling system. Ceiling systems and suspended ceiling systems are well known in the art. The present invention provides for ceiling systems having unique aesthetic and acoustic qualities.

In certain embodiments, the invention is a method for installing a ceiling system having a building panel as described herein. In certain embodiments, the invention is a method for using a building panel as described herein within a ceiling system.

In other embodiments, the invention is a building panel (Building panel 1.1) comprising a frame member comprising a vertical side wall having an inner surface opposite an outer surface; and a bottom flange having an upper surface opposite a lower surface; a mesh member comprising a first major surface opposite a second major surface, the second major surface comprising a central region circumscribed by a perimeter region; a securing member; and wherein the perimeter region of the second major surface of the mesh member is coupled to the lower surface of the bottom flange of the frame member; and wherein the securing member is coupled to the frame member. In other embodiments, the invention is Building panel 1.1, wherein the mesh member comprises a metal mesh (Building panel 1.2). In certain embodiments, Building panel 1.2, wherein the metal mesh comprises steel (Building panel 1.3). In certain embodiments, any one of Building panels 1.1 to 1.3, wherein the mesh member comprises a welded wire mesh (Building panel 1.4). In certain embodiments, any one of Building panels 1.1 to 1.4, wherein the mesh member comprises wires oriented perpendicular to each other (Building panel 1.5). In certain embodiments, any one of Building panels 1.1 to 1.5, wherein the securing member contacts the inner surface of the vertical side wall of the frame member (Building panel 1.6). In certain embodiments, any one of Building panels 1.1 to 1.6, wherein the perimeter region of the mesh member extends to the outer surface of the vertical side all of the frame member (Building panel 1.7). In certain embodiments, any one of Building panels 1.1 to 1.7, the building panel comprising a first major exposed surface opposite a second major exposed surface, wherein the first major exposed surface comprises the first major surface of the mesh member and at least a portion of the lower surface of the bottom flange of the frame member (Building panel 1.8). In certain embodiments, any one of Building panels 1.1 to 1.8, wherein the mesh member comprised a plurality of intersecting mesh strands having an intersection distance ranging from about 0.75 in to about 2.5 in (Building panel 1.9). In certain embodiments, any one of Building panels 1.1 to 1.9, wherein the mesh member comprises a first set of parallel wires and a second set of parallel wires, and wherein the first set of parallel wires are positioned above and abut the second set of parallel wires (Building panel 1.10). In certain embodiments, Building panel 1.10, wherein each of the first set of parallel wires extend from a first end to a second end and each of the second set of parallel wires extend from a first end to a second end, and wherein the first and second ends of the first set of parallel wires are located in the perimeter region, and wherein the first and second ends of the second set of parallel wires are located in the perimeter region (Building panel 1.11). In certain embodiments, Building panel 1.10 or 1.11, wherein the first and second ends of the first set of parallel wires overlap vertically with the vertical side wall of the frame member; and wherein the first and second ends of the second set of parallel wires overlap vertically with the vertical side wall of the frame member (Building panel 1.12). In certain embodiments, any one of Building panels 1.1 to 1.12, wherein the securing member comprises a vertical wall plate and a hook member (Building panel 1.13). In certain embodiments, Building panel 1.13, wherein the vertical side wall of the frame member comprises a top edge opposite a bottom edge, and wherein the hook member is located between the top edge and the bottom edge of the vertical side wall of the frame member (Building panel 1.14). In certain embodiments, any one of Building panels 1.1 to 1.14, wherein the vertical side wall further comprises a cutout region, and wherein the hook member of the securing member at least partially overlaps with the cutout region of the vertical side wall of the frame member (Building panel 1.15). In certain embodiments, any one of Building panels 1.1 to 1.15, wherein the building panel further comprises a torsion spring (Building panel 1.16).

In other embodiments, the invention is a building panel comprising a frame member comprising a vertical side wall having an inner surface opposite an outer surface; a mesh member comprising a first major surface opposite a second major surface, the second major surface comprising a central region circumscribed by a perimeter region; a securing member comprising a saddle bracket; and wherein the perimeter region of the second major surface of the mesh member is coupled to the frame member; and wherein the securing member is coupled to the frame member. In certain embodiments, the vertical side wall of the frame member at least partially nest inside of a receiving cavity of the saddle bracket. In certain embodiments, the saddle bracket comprises a first wall plate, a second wall plate, and a bight portion connecting the first and second wall plates, wherein the receiving cavity is located between the first wall plate and the second wall plate. In certain embodiments, the saddle bracket is secured to the frame member by a fastener extending through the vertical side wall of the frame member and at least one of the first wall plate and the second wall plate. In certain embodiments, the saddle bracket comprises a cutout region formed into the big portion and the vertical wall of the frame member comprises a cutout region, and wherein the cutout region of the vertical wall of the frame member and the cutout region of the saddle bracket at least partially overlap. In certain embodiments, the saddle bracket further comprises a hook. In certain embodiments, the mesh member comprises a metal mesh. In certain embodiments, the metal mesh comprises steel. In certain embodiments, the mesh member comprises a welded wire mesh. In certain embodiments, the mesh member comprises wires oriented perpendicular to each other. In certain embodiments, the frame member further comprises a bottom flange having an upper surface opposite a lower surface, the mesh member coupled to the lower surface of the bottom flange. In certain embodiments, the perimeter region of the mesh member extends to the outer surface of the vertical side all of the frame member. In certain embodiments, the building panel comprising a first major exposed surface opposite a second major exposed surface, wherein the first major exposed surface comprises the first major surface of the mesh member and at least a portion of the lower surface of the bottom flange of the frame member. In certain embodiments, the mesh member comprised a plurality of intersecting mesh strands having an intersection distance ranging from about 0.75 in to about 2.5 in. In certain embodiments, the mesh member comprises a first set of parallel wires and a second set of parallel wires, and wherein the first set of parallel wires are positioned above and abut the second set of parallel wires. In certain embodiments, each of the first set of parallel wires extend from a first end to a second end and each of the second set of parallel wires extend from a first end to a second end, and wherein the first and second ends of the first set of parallel wires are located in the perimeter region, and wherein the first and second ends of the second set of parallel wires are located in the perimeter region. In certain embodiments, the first and second ends of the first set of parallel wires overlap vertically with the vertical side wall of the frame member; and wherein the first and second ends of the second set of parallel wires overlap vertically with the vertical side wall of the frame member.

In further embodiments, the invention is a ceiling system comprising a plurality of support members and at least one of the building panels as described herein. In certain embodiments, the at least one building panel is supported from the plurality of support members by a torsion spring connected to the securing member of the building panel.

In further embodiments, the invention is a saddle bracket comprising a bight portion; a first wall plate extending downward from the bight portion to a first bottom edge; a second wall plate extending downward from the bight portion to a second bottom edge; a cutout out region extending downward from the bight portion into each of the first wall plate and the second wall plate; and a hook member extending from the first wall plate, the hook member at least partially overlapping with the cutout region along a vertical direction; and wherein the bight portion, the first wall plate, and the second wall plate collectively forming a receiving cavity that extends along a central vertical plane. In certain embodiments, the saddle bracket further comprises a first lower plate extending from the first bottom edge of the first wall plate to a first lower plate edge. In certain embodiments, the first lower plate overlaps with the cutout region. In certain embodiments, a distal end of the hook member is located between the first bottom edge of the first wall plate and the first lower plate edge of the first lower plate. In certain embodiments, the saddle bracket further comprises a second lower plate extending from the first bottom edge of the first wall plate to a first lower plate edge. In certain embodiments, the second lower plate overlaps with the cutout region. In certain embodiments, a first wall plate extends longitudinally a first distance and the cutout region extends longitudinally a second distance, and the first lower plate extends longitudinally a third distance, wherein the third distance is less than the first distance. In certain embodiments, the second distance is less than the third distance.

In further embodiments, the invention is a saddle bracket comprising a bight portion; a first wall plate extending downward from the bight portion to a first bottom edge; a second wall plate extending downward from the bight portion to a second bottom edge; a first elongated section comprising the bight portion, the first wall plate, and the second wall plate; a second elongated section comprising the bight portion, the first wall plate, and the second wall plate; a third elongated section comprising the bight portion, the first wall plate, and the second wall plate; and a fourth elongated section comprising the bight portion, the first wall plate, and the second wall plate; wherein the first elongated section and the second elongated section are parallel, and wherein the third elongated section and the fourth elongated section are parallel, and wherein the first elongated section, the second elongated section, the third elongated section, and the fourth elongated section collectively forming a receiving cavity. In certain embodiments, the first elongated section comprises a cutout region formed into the bight portion and the second elongated section comprises a cutout region formed into the bight portion. In certain embodiments, the first elongated section comprises a hook member and the second elongated section comprises a hook member. In certain embodiments, the hook member of the first elongated section overlaps with the cutout region of the first elongated section and the hook member of the second elongated section overlaps with the cutout region of the second elongated section. In certain embodiments, the second wall plate extends continuously through the first elongated section, the second elongated section, the third elongated section, and the fourth elongated section. In certain embodiments, the first wall plate is interrupted between the first elongated section, the second elongated section, the third elongated section, and the fourth elongated section. In certain embodiments, the bight portion is interrupted between the first elongated section, the second elongated section, the third elongated section, and the fourth elongated section.

While the present invention has been described with reference to several embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention is to be determined from the claims appended hereto. Further, it will be apparent to those of skill in the art that numerous changes may be made in such details without departing from the spirit and the principles of the invention.

What is claimed is:

1. A building panel comprising:

a mesh member comprising a first major surface opposite a second major surface, and four side surfaces extending there-between;

a frame member comprising a vertical side wall having an inner surface opposite an outer surface and an upper surface opposite a lower surface;

wherein the first major surface and the second major surface are defined by a perimeter, the perimeter comprising a proximal end and a distal end;

wherein the perimeter of the second major surface is in contact with the lower surface of the frame member;

wherein the frame member further comprises a securing member at the upper surface at the proximal end and at the distal end;

wherein the securing member comprises a torsion spring bracket;

wherein the torsion spring backet is an integrally formed singular component comprising a wall plate, a hook member extending from the wall plate, an upper plate extending from a top portion, a base plate extending from a base portion, the upper plate and base plate extending parallel to each other and perpendicular to the wall plate; and wherein the torsion spring bracket comprises a saddle bracket comprising a first wall plate, a second wall plate, and a bight portion connecting the first second wall plates, the bight portion comprising a wing portion extending laterally away from a cutout region of the frame member, the wing portion having a height extending from a cutout region floor to a top cervical wall of the frame member.

2. The building panel of claim 1, wherein the mesh comprises a metal mesh, and wherein the metal mesh is welded to the lower surface of the frame member.

3. The building panel of claim 1, wherein the frame member comprises a wall cutout region contacting the securing member, and wherein the wall cutout region extends downward from the upper surface toward the lower surface.

4. The building panel of claim 3, wherein the torsion spring bracket is mounted on the cutout region and wherein the securing member comprises a torsion spring having a J shaped end.

5. The building panel of claim 1, wherein the bight portion of the saddle bracket is located above the upper surface of the frame member; and wherein the first wall plate is located adjacent to the inner surface of the frame member; and wherein the second wall plate is located adjacent to the outer surface of the frame member.

6. A saddle bracket for a ceiling system, the saddle bracket comprising:

a saddle member comprising:

a bight portion, a first wall plate, and a second wall plate collectively defining a frame receiving cavity that extends along a central vertical plane;

a cutout out region extending downward from the bight portion into the first wall plate and the second wall plate; and a hook member extending from the first wall plate; wherein hook member at least partially overlaps with the cutout region along a vertical direction; and wherein the bight portion includes a wing portion extending laterally away from the cutout region, the wing portion having a height extending from a cutout region floor to a top cervical wall.

7. The saddle bracket according to claim 6, wherein the hook member comprises:

a first portion extending from the first wall plate;

a second portion extending from the first portion; and a third portion extending from the second portion;

wherein the cutout region extends from the bight portion to a cutout region floor, the first portion extends upward from a cutout region floor, the second portion extends outward from the first portion; and the third portion extends downward from the second portion.

8. The saddle bracket according to claim 7, wherein the second portion is located vertically between the cutout region floor and the bight portion.

9. A ceiling system comprising:

a ceiling suspension grid;

a building panel comprising:

a mesh member comprising wires perpendicular to each other, a first major surface opposite a second major surface, and four side surfaces extending there-between;

a frame member comprising a vertical side wall having an inner surface opposite an outer surface and an upper surface opposite a lower surface;

wherein the first major surface and the second major surface are defined by a perimeter, the perimeter comprising a proximal end and a distal end;

wherein the perimeter of the second major surface is in contact with the lower surface of the frame member;

wherein the frame member comprises a wall cutout region contacting the securing member, the wall cutout region extending downward from the upper surface toward the lower surface; and wherein the frame member further comprises a securing member at the upper surface at the proximal end and at the distal end; and a back panel positioned between the building panel and the suspension grid;

wherein a torsion spring bracket is mounted on the cutout region;

wherein the frame comprises two apertures from the inner surface to the outer surface, each aperture flanking the cutout region and abutting the torsion spring bracket; and wherein the torsion spring bracket comprises a wall plate having at least two apertures aligned with the apertures of the frame.

10. The ceiling system of claim 9, wherein the mesh is a metal mesh.

11. The ceiling system of claim 9, wherein the building panel has a parallelogram shape having perpendicular angles, the mesh is made of a first and second set of parallel wires, wherein each set is perpendicular to the other, wherein the first set is atop and abuts the second set;

wherein the perimeter further comprises side ends;

wherein the proximal perimeter end and the distal perimeter end comprise a continuous wire body as the perimeter; and wherein the side ends comprise a continuous wire body and having discrete wire side end atop and abutting the continuous wire body as the perimeter.

12. The ceiling system of claim 9, wherein the mesh is welded to the lower surface of the frame member.

13. The ceiling system of claim 9, wherein the back panel is comprised of an acoustic material.

* * * * *